US006595319B1

(12) United States Patent
Huff

(10) Patent No.: US 6,595,319 B1
(45) Date of Patent: Jul. 22, 2003

(54) MUFFLER

(76) Inventor: Ronald G. Huff, 3741 Cinnamon Way, Westlake, OH (US) 44145

( * ) Notice: Subject to any disclaimer, the term of this patent is extended or adjusted under 35 U.S.C. 154(b) by 0 days.

(21) Appl. No.: 10/013,044

(22) Filed: Oct. 30, 2001

(51) Int. Cl.[7] ..... F01N 1/02
(52) U.S. Cl. ..... 181/250
(58) Field of Search ..... 181/250, 247–249, 181/251, 266, 267, 268, 273, 275, 276

(56) References Cited

U.S. PATENT DOCUMENTS

| | | | | |
|---|---|---|---|---|
| 823,115 A | | 6/1906 | Gramm | |
| 1,736,319 A | * | 11/1929 | Maxim | 181/267 |
| 4,006,793 A | | 2/1977 | Robinson | 181/53 |
| 4,046,219 A | | 9/1977 | Shaikh | 181/211 |
| 4,185,715 A | | 1/1980 | Reu Boiu | 181/266 |
| 4,220,219 A | | 9/1980 | Flugger | 181/265 |
| 4,557,349 A | | 12/1985 | Crump | 181/279 |
| 4,790,409 A | | 12/1988 | Deaver | 181/265 |
| 4,848,513 A | | 7/1989 | Csaszar | 181/265 |
| 5,129,793 A | | 7/1992 | Blass et al. | 417/312 |
| 5,168,132 A | | 12/1992 | Beidl et al. | 181/265 |
| 5,350,888 A | | 9/1994 | Sager, Jr. et al. | 181/247 |
| 5,413,189 A | | 5/1995 | Browning et al. | 181/268 |
| 5,502,283 A | | 3/1996 | Ukai et al. | 181/228 |
| 5,659,158 A | | 8/1997 | Browning et al. | 181/268 |
| 5,952,625 A | | 9/1999 | Huff | 181/265 |
| 6,199,658 B1 | | 3/2001 | Huff | 181/265 |

FOREIGN PATENT DOCUMENTS

JP 362007924 * 1/1987

OTHER PUBLICATIONS

Schaum's Outline Series, McGraw–Hill Book Company, Theory and Problems of Acoustics, William W. Seto, pp. 111 and 113.

Handbook of Noise Control, McGraw–Hill Book Company, Acoustical Filters and Mufflers, Don D. Davis, Jr., Chapter 21, 21–1–21–44.

* cited by examiner

*Primary Examiner*—Shih-Yung Hsieh
(74) *Attorney, Agent, or Firm*—Pearne & Gordon LLP

(57) ABSTRACT

A high performance muffler for an internal combustion engine of a passenger vehicle includes a straight through main pipe and a side branch open at one end to the main pipe and at the other end to the atmosphere. The side branch is tuned to attenuate a noise frequency that is loudest in the passenger compartment of the vehicle when the engine is operated without a muffler. Numerous embodiments of the invention are disclosed including arrangements in which the side branch pipe has acoustic path sections that are folded on one another to reduce the axial length of a main envelope of the side branch pipe.

6 Claims, 4 Drawing Sheets

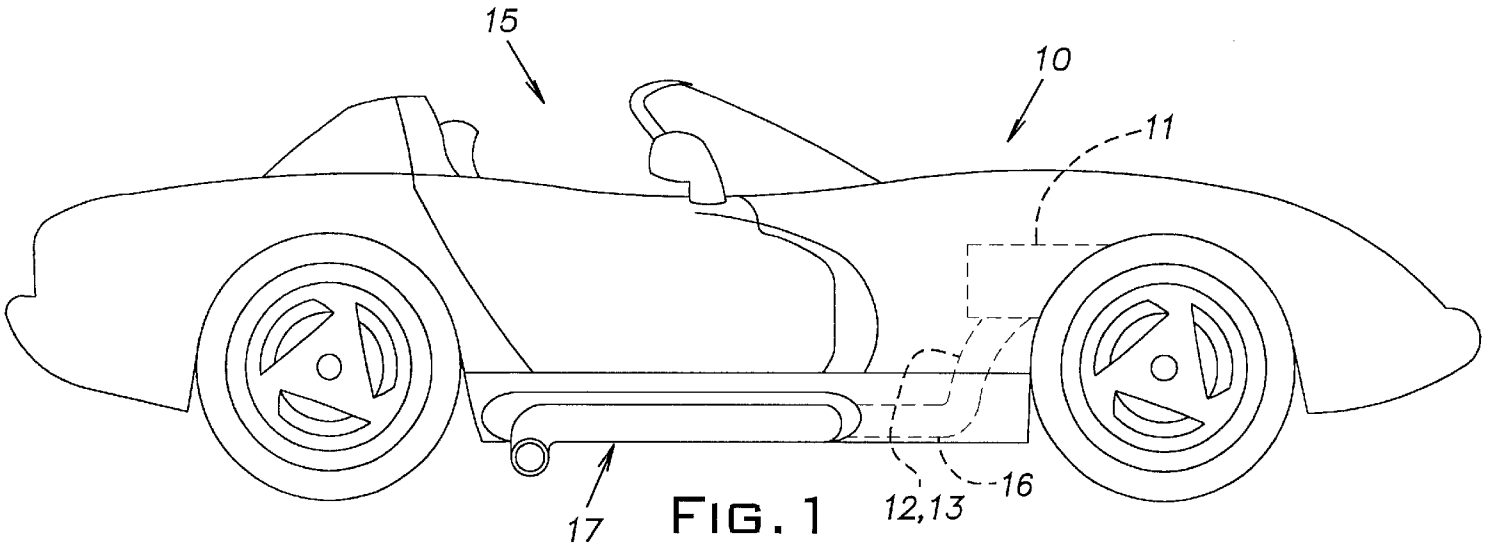
FIG. 1
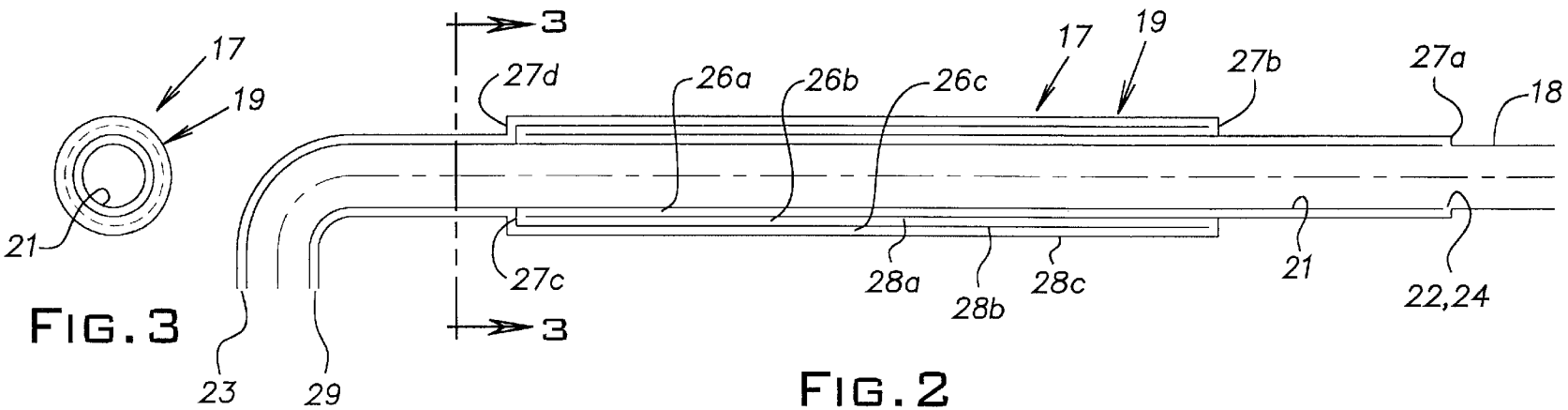
FIG. 2
FIG. 3

MUFFLER

BACKGROUND OF THE INVENTION

The invention relates generally to mufflers of the type used with internal combustion engines to attenuate engine exhaust noise and, more particularly, mufflers conventionally referred to as "side branch mufflers".

The invention is particularly applicable to and will be described with specific reference to a straight-through muffler for use in sports cars or high performance automotive vehicles. However, it will be appreciated by those skilled in the art that the inventive concepts disclosed herein may be utilized for any number of muffler applications and in combination with or as part of other muffler systems or arrangements for attenuating a specific frequency or a specific range of frequencies.

Engine noise from an internal combustion engine typically is generated by the sudden expansion of combustion chamber gases released from a combustion chamber. As the combustion gases are released and exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object an over pressure is created at the surface of the object and it is this over pressure that is a direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate the size of the muffler which typically must be kept as small as possible. Further means of attenuating engine noise include the use of packing and complex baffle systems. However, these approaches are often accompanied by a substantial increase in the back pressure or resistance of the muffler to freely discharge the combustion gases. The increase in back pressure can result in a decrease of the output horsepower of the engine with a resulting loss of efficiency in fuel economy.

Mufflers are classified in various manners within the art. From a structural consideration, mufflers have been classified as being either of two basic types or configurations:

1. A compartmentalized type which comprises several compartments sealed except for the inlets and outlets, the compartments usually-being sealed noise entrapment chambers; or
2. A type commonly known as a straight-through muffler which usually comprises a duct having a series of perforations within a sealed housing.

In accordance with this classification, the invention is particularly adaptable to mufflers of the straight through type, although it can have application to compartmentalized type mufflers.

From a functional view, mufflers may be classified as dissipative or reactive. Dissipative mufflers are typically composed of ducts or chambers filled with acoustic absorbing materials such as fiberglass, steel wool, or porous ceramics. Such materials absorb acoustic energy and transform it into thermal energy. Reactive mufflers, on the other hand, are composed of a number of interconnected chambers of various sizes and shapes in which sound waves are reflected to dampen or attenuate waves of a set frequency, typically resonance frequency. This invention relates to.a reactive type muffler.

There are two types of reactive mufflers. A side branch type muffler and a resonator type muffler. A resonator type muffler uses various volumes of different shapes or sizes, i.e. resonance chambers interconnected with pipes and can dampen not only resonance frequency, but also sound waves having frequencies near the resonance frequency. The drawback to resonator mufflers is the large volume required to dampen low frequency sound waves.

The side branch muffler is the type of muffler to which the present invention relates. Generally, the side branch muffler has a straight through pipe and an offset or side branching off the straight through pipe. The side branch pipe is closed at its end and may be bent or shaped with baffles. My U.S. Pat. Nos. 5,952,625 and 6,199,658 disclose a multi-fold side branch muffler that has advanced the art of side branch mufflers and such patents are incorporated herein by reference in their entireties.

When the sound wave front reaches the closed end of the side branch, it reflects back towards the open end thereby damping waves at the same frequency and out of phase with the reflected wave. Closed side branch mufflers such as disclosed in my aforementioned U.S. patents, have the limitation that they attenuate the fundamental and the odd harmonics of an objectionable frequency, but are not effective to reduce all of the harmonics. It has been found that particular engines and/or engine and vehicle combinations have noise characteristics in which the fundamental and all of the harmonics, or at least all of those near the fundamental frequency, are of consequence, i.e. loud.

Apart from the functional and structural considerations discussed above, sports cars and high performance vehicles have additional requirements. It has long been known that the exhaust systems of such vehicles must be tuned to emit certain sounds from the automobile which appeal to the purchaser of such vehicles, all while satisfying noise regulations or standards. Such applications require attenuation of specific waves having set frequencies to produce the desired sound. More particularly, high performance mufflers of the type under discussion are tuned to the specific type of engine to which the muffler will be applied. Specifically, the valving or breathing characteristics of the engine are matched to the muffler over the operating range of the engine to produce the desired tone. Recent engineering advances in the structural rigidity of the body or chassis of the vehicle in which the engine is mounted have enhanced the sound of the engine within the cabin or passenger compartment of the vehicle. Specifically, a muffler can be tuned to meet a desired sound with the engine on a test stand, but the muffler can produce objectionable resonance in the cabin. Since the cabin typically cannot be dampened, the muffler has to be precisely tuned to attenuate the sound waves producing the objectionable resonance within the cabin.

SUMMARY OF THE INVENTION

The invention affords a remarkably simple but surprisingly effective side branch muffler system that operates to reduce noise at a design frequency or limited band of frequencies and all of the harmonics. The invention resides in the provision of a side branch on a main exhaust pipe that is open at both ends and that has a length selected to cancel a particular design frequency. The side branch can have innumerable configurations but most typically runs parallel to the main exhaust pipe. As disclosed, the side branch pipe can lie alongside the main pipe or can be concentric with it. In either of these arrangements and in others where physical or economic constraints exist, for example, the side branch pipe can be folded on itself to reduce the length of its physical package.

When the invention is applied to passenger vehicles, for example, the muffler can be tuned so that it is most effective at the dominant resonant frequency in the passenger compartment. A muffler constructed in accordance with the invention is especially useful where increased power and/or fuel efficiency is of particular concern since it reduces back pressure in the exhaust system compared to more conventional muffler arrangements.

BRIEF DESCRIPTION OF THE DRAWINGS

FIG. 1 is a schematic view of a high performance sports car having a side exhaust system embodying the invention;

FIG. 2 is a schematic longitudinal cross-sectional view of a side branch muffler constructed in accordance with the invention;

FIG. 3 is a cross-sectional axial view of the muffler taken in the plane 3—3 indicated in FIG. 2;

DESCRIPTION OF THE PREFERRED EMBODIMENT

Figure 4:
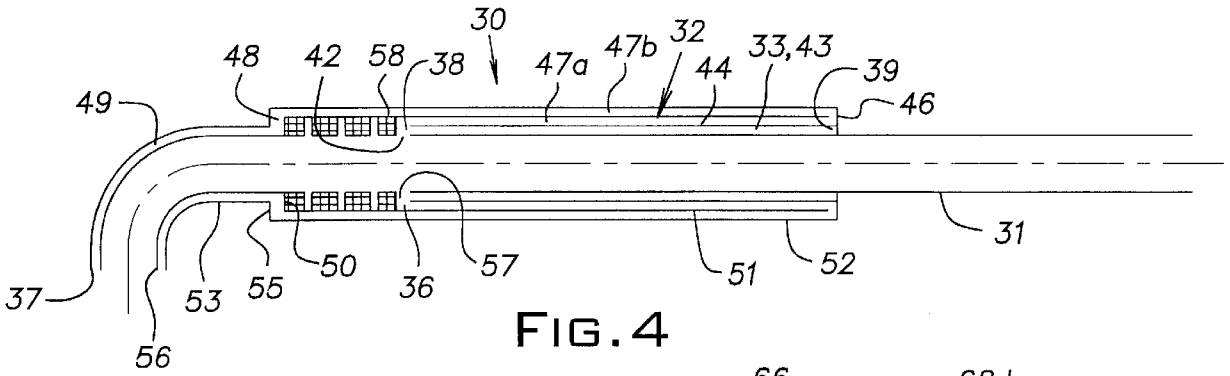
FIG. 4 is a longitudinal cross-sectional view of a second embodiment of a muffler constructed in accordance with the invention.

Referring now to the drawings, FIG. 1 illustrates a vehicle 10 propelled by an internal combustion engine 11. The illustrated vehicle 10 is a land vehicle and, more particularly, is a passenger automobile in the form of a high-performance two-seat sports car such as a Viper sold by Daimler Chrysler Corporation. The vehicle 10 includes a passenger compartment or cabin 15. The engine 11 in the illustrated embodiment, is a V-10 engine. Each bank of cylinders is preferably provided with a separate exhaust circuit, one circuit on each side of the body along the "rocker panel", i.e. adjacent and parallel with the door threshold. At each side, an exhaust circuit includes so-called "headers" or an exhaust manifold having branches that each collect exhaust gases from one of the cylinders through its respective exhaust valve or valves and convey such gases to an exhaust pipe 16 of the exhaust circuit. The exhaust circuit, besides the headers and exhaust pipe 16, includes a muffler 17 shown in detail in FIGS. 2 and 3. The muffler 17 has a main pipe 18 and a side branch pipe 19. The main and side branch pipes 18, 19 in the illustrated example are, for the most part, cylindrical in form. The main pipe 18 has a straight-through structure without any reverses in direction or other major flow restrictions existing in its internal passage, designated 21. The side branch pipe 19 is open at one end in direct fluid communication with the main pipe 18 through a circumferential slot 22 in the main pipe and is open at its other end 23 in direct fluid communication with the atmosphere. The side branch pipe 19 is concentric with and encircles the main pipe 18 and includes a plurality of acoustic path sections 26*a–c* concentric with each other and folded axially on one another. The folded structure of the side branch pipe 19 results in some of the path sections 26 sharing the same axial location along the main pipe 18, the axial direction defined in this instance as the axis of the main pipe. Annular end plates 27*a–d* forming radial walls are welded or otherwise fixed between successive side branch pipe section walls 28*a–c* to properly locate the pipe section walls and to direct sound pressure waves to successive sections 26 of the side branch pipe 19 as discussed below.

The muffler 17 is preferably fabricated of stainless steel round tubing with a wall thickness of 1/16", for example. The main pipe 18 can have a nominal diameter of 2½" and the pipe section walls 28 forming the axially folded or serpentine path sections 26 have increasingly larger diameters. The sizes of the concentric pipe section walls 28*a–c* are selected so that the annular cross-sectional area of each path section 26*a–c* is approximately equal to the cross-sectional area of the main pipe 18 and is preferably at least 70% of such area. Since the circumference of the acoustic path sections 26 increases with distance from the axis of the main pipe 18, the radial spacing between walls 28*a–c* can decrease successively further from the main pipe.

The upstream open end 24 of the side branch pipe 19 is formed by the slot 22 in the wall of the main pipe 18; the slot is preferably circumferentially continuous and, accordingly, amounts to an axial gap in the wall of the main pipe 18. Ideally, the slot 22 is free from any obstruction, such as a supporting bracket, around the full circumference of the main pipe 18. If radial supports are necessary between the main pipe 18 and the side branch pipe 19 are necessary for structural rigidity, these elements should have their cross sections minimized for reducing unwanted sound wave reflection. The area of the slot 22 should preferably be at least 70% of the cross-sectional flow area of the main pipe 18 and, more preferably, should be at least 80% of such flow area. Generally, gaps between the ends of pipe section walls 28*a–c* and adjacent annular end plates 27*a–d* should have the same size area as the slot 22. This size of opening or slot area and the cross-sectional area specified above will assure effective sound attenuation of the side branch pipe 19 as discussed below.

The effective length of the side branch pipe 19 is the sum of the lengths of the path sections 26*a–c* measured along the middle of the sound paths they form. More specifically, where the sound path between the various sections is radial, the path is considered to lie at the radius in the respective annular gaps midway between the cylindrical pipe sections walls 28*a–c* and midway in the gaps between the ends of the section walls and the annular end plates 27. It will be seen that the downstream open end 23 of the side branch pipe 19 in this embodiment terminates at an annular zone concentric with and essentially coplanar with the plane of the downstream end designated 29 of the main pipe. It should be understood that these downstream ends of the main pipe 18 and side branch pipe 19 can be bent in an angle such as that suggested in FIG. 2.

The muffler 17 operates in the following way to attenuate excessive exhaust noise from the engine 11. Sound pressure waves produced by the rapid opening of the exhaust valves of the engine and violent release of pressurized combustion gases travel into the main pipe 18. When a sound wave reaches the opening or slot 22, some of it propagates through the side branch pipe 19. The direction of the wave changes at the radial end plates or walls 27 such that it is caused to travel the full length of the side branch through successive path sections 26*a–c*. When the wave reaches the downstream end 23 of the side branch 19, the sound wave is reflected, due to physical phenomena, back through the entire length of the side branch pipe.

If the length of the side branch pipe 19, from its open end 24 at the slot 22 to its open downstream end 29 through the folded path sections 26*a–c* is equal to one-half of the wavelength of the sound of a particular frequency, the returning or reflected wave in the side branch pipe will arrive at the upstream opening 24 at the same time a succeeding wave in the main pipe 18 reaches this opening (formed by the slot 22). This circumstance allows the reflected wave to dissipate some of the sound energy of the succeeding wave, thereby reducing the noise that can pass through the muffler 17. It has been discovered that a muffler with an essentially straight-through main pipe and a side branch pipe open at both ends can be tuned to the physical system of a vehicle produced primarily by the engine and the passenger compartment of the vehicle to achieve a surprisingly high level of attenuation for passenger comfort in the cabin 15 while significantly enhancing performance. In accordance with the invention, an internal combustion engine propelled vehicle such as the vehicle 10 illustrated in FIG. 1 is initially fitted with a straight-through exhaust pipe, i.e. an exhaust circuit with no muffler. The vehicle 10 is then operated through a full range of engine speed while sound measurements are made within the vehicle passenger compartment or space 15. The sound testing instrumentation measures the frequency or narrow band of frequencies primarily of engine exhaust noise that, through resonances in the vehicle body, produces the highest sound pressure level in the passenger compartment. The muffler 17 is designed to suppress that frequency or narrow band of frequencies by making the effective length of the side branch pipe 19 equal to the half wavelength of such frequency or middle of such narrow band of frequencies. The half wavelength "L" (in inches) is given by the following equation:

$$L = \frac{C \cdot 12}{f \cdot 2}$$

where "C" is sonic velocity in ft/sec and "f" is the design frequency in Hz.

The disclosed muffler 17 with its open end side branch pipe 19 has the ability to attenuate the fundamental design frequency and all of its harmonics. This ability is especially important in engine designs that product strong (i.e. high sound pressure level) odd and even harmonics of the fundamental frequency that the muffler is designed to attenuate.

FIG. 4 illustrates a second embodiment of the invention where a side branch muffler 30 includes a main pipe 31 and two side branches 32–33. One side branch 32 is open at both ends 36, 37. The other side branch 33 is open at one end 38 and closed at its other end 39. The muffler 30 has a configuration similar to the muffler 17 shown in FIGS. 1–3 such that the main pipe 31 is a cylindrical tube and the side branches 32, 33 are formed with cylindrical walls concentrically arranged around the main pipe. The upstream or entrance ends 36, 38 (with reference to the direction of an entering sound wave) for both side branches 32, 33 is commonly formed by a circumferentially continuous annular slot 42 in the wall of the main pipe 31. The closed end side branch 33 has an annular sound wave path 43 formed at its inner radial boundary by the wall of the main pipe 31 and at its outer radial boundary by a cylindrical tube 44. The side pipe 33 is closed at its downstream end with an annular radial wall 46. The other side branch 32 is concentric about the side branch pipe 33 and the main pipe 31 including a portion of the main pipe axially beyond the side branch pipe 33. The open/open side branch pipe 32 has concentric annular acoustic path sections 47*a* and 47*b* where it is partially folded on itself, an annular radially stepped sound path section 48 and a downstream annular reduced diameter section 49. Circumferential boundaries of the sound path sections 47*a* and 47*b* are formed, sequentially, by the tube 44 and additional cylindrical tubes 51, 52. The tube 51 is spaced from the radial wall 46 to form an annular slot between the sections 47*a*, 47*b*. A radial annular wall 50 seals the side branch sound path section 47*b* from the interior of the main pipe 31 and an annular radial wall 55 makes a transition between the relatively large diameter of the outer tube 52 and a downstream circular tubular wall portion 53 of the side branch 32. The tubular wall portion 53 can be arranged to have the open end 37 coplanar or nearly coplanar with an open end 56 of the main pipe 31.

A preferably imperforate radial wall 57, at the slot 42 extends between the main pipe 18 and the wall 50. A portion of the wall of the main pipe 18 between the radial walls 57, 51 is perforated. The perforated wall area is surrounded with sound dissipative material 58 such as stainless steel wool.

In use with an internal combustion engine, the muffler 30 is located so that the exhaust from the ends 56, 37 of the main pipe 31 and side branch 32 are behind at least the major portion, with reference to the forward direction of the vehicle, of the passenger compartment. The open/open side branch 32 operates in the manner described above in connection with the muffler 17 illustrated in FIGS. 2 and 3, the combined length of the acoustic path of this side branch 32 is tuned to attenuate the frequency or narrow frequency band that is loudest in the passenger compartment of the vehicle on which it is installed. Similarly, as taught in my aforementioned U.S. Pat. No. 5,952,625, the open/closed side branch 33 can also be turned to attenuate these objectionable frequencies and augment the performance of the open/open branch. The sound dissipative material 58 also contributes to the attenuation of sound energy to augment the sound attenuating performance of the muffler 30.

Figure 5:
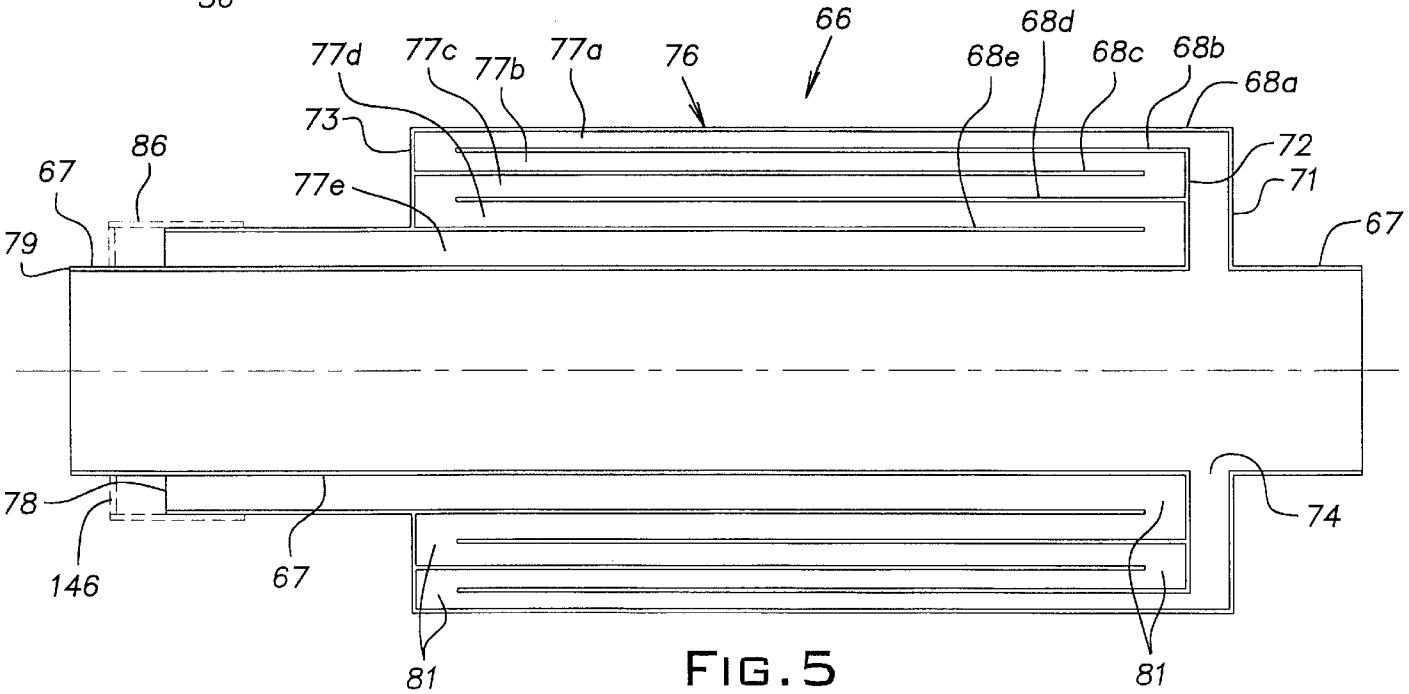
FIG. 5 is a longitudinal cross-sectional view of a third embodiment of a muffler constructed in accordance with the invention.

Referring to FIG. 5, there is shown a third embodiment of the invention in which a side branch muffler 66 has its acoustic path folded on itself numerous times to shorten the space it occupies in the axial or longitudinal direction of a main pipe 67. As seen, the muffler 66 includes a plurality of concentrically arranged cylindrical tubes or pipes 68*a–e*. The tubes 68, preferably, are made of corrosion-resistant steel such as stainless steel or galvanized steel and are attached, as by welding, to axially spaced annular walls 71–73. Two of the walls 71, 72 are attached and sealed on the main pipe 67 at opposite sides of an annular circumferentially continuous opening or slot 74 in the wall of the main pipe 67.

The tubes 68*a–e* and walls 71–73 form a side branch pipe circuit 76 open at both ends (open/open) that is relatively long compared to the length of the envelope in which it exists. This envelope is defined primarily by the walls 71 and 73 and the outer shell 68*a*. The slot 74 forms the inlet opening of the side branch circuit 76. The side branch acoustic path begins at this opening 74 and extends radially in the space between the walls 71, 72. From this space, the path extends serially through axial paths 77*a–e* between the several concentric tubes or pipes 68*a–e*. As shown in FIG. 5, one end of each tube 68b-e is spaced with a gap 81 between it and a radial wall 72 or 73 to permit radial fluid communication between the sound path sections. The innermost tube 68e is extended so that its end 78 is adjacent an outlet end 79 of the main pipe 67.

The axial length of the slot 74 as well as the length of gaps 81 between the tubes 68b-e and the walls 72, 73 should provide a flow area at least equal to 70% of the area of the main pipe 67. It should be understood that the radial space between adjacent tubes forming the path 77*a–e* can be decreased with increasing distance from the center of the muffler 66. As explained in connection with the muffler of FIGS. 2 and 3, the cross-sectional area of the successive path 77*a*–77*e* can be maintained constant or nearly constant while the radial width of these path sections is reduced because the circumferential length of these path sections is increased.

The length of the side branch pipe circuit 76, being the sum of successive paths 77*a–e* can be sized, as discussed before, to attenuate the frequency of exhaust noise that is the loudest in a passenger compartment of the vehicle on which the muffler 66 is installed. To fine tune the muffler 66, an adjustable sleeve, shown in phantom at 86 in FIG. 5, can be closely fitted or otherwise sealed over the end 78 of the side branch pipe 68*e* to adjust the effective length of the side branch circuit 76. The sleeve 86 can be used by an original equipment manufacturer to determine the ideal length of a side branch pipe 76 and then the inner pipe 68*e* can be appropriately lengthened to that length corresponding to the location of the free end of the sleeve 86 for purposes of production. Alternatively, the sleeve 86 can be supplied with the muffler 66 so that the owner or user of a vehicle can adjust the tone of the muffler to his or her preference.

Figure 6:
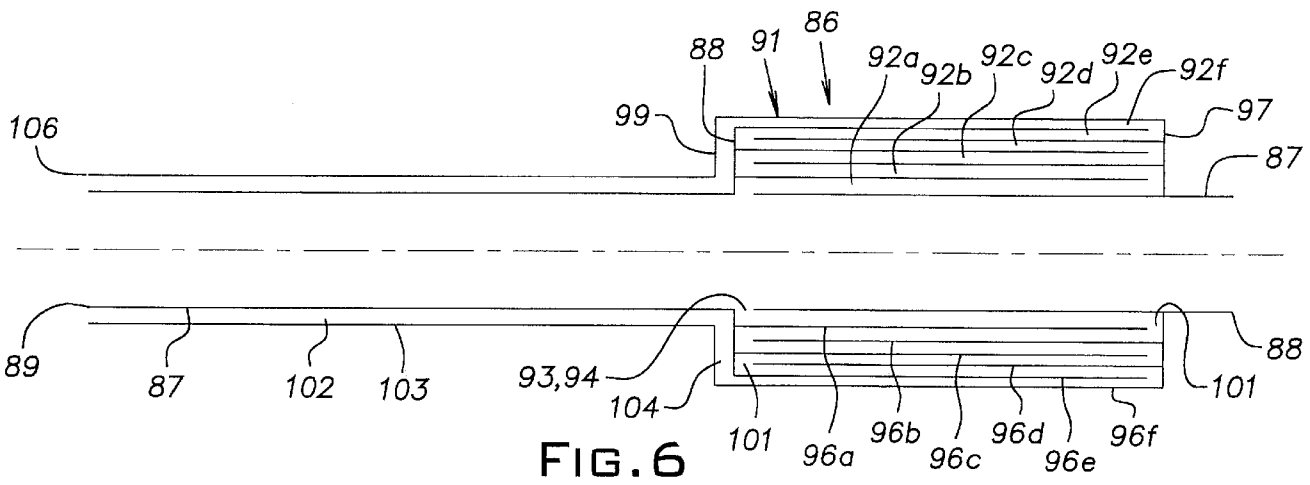
FIG. 6 is a longitudinal cross-sectional view of still another embodiment of a muffler constructed in accordance with the invention.

FIG. 6 illustrates still another embodiment of the invention in the form of a side branch muffler 86 particularly suited for use in piston engine aircraft. As in previous embodiments, the muffler 86 includes a central main pipe 87 having an inlet end 88 and an exhaust or outlet end 89. Constructed around the main pipe 87 is a side branch 91 open at both ends. The side branch 91 has several concentric acoustic path sections 92*a–f* formed in a manner similar to those described in connection with FIG. 5. In this arrangement, by contrast, an upstream entrance 93 of the side branch, formed by a circumferentially continuous slot 94 in the main pipe is remote from the engine or upstream side of the main pipe represented by the inlet end 88. The path sections 92*a–f* are folded over one another, again to axially shorten the main envelope of the muffler 86.

The acoustic path sections 92*a–f* are formed between concentric cylindrical tubes or pipes 96*a–f* (and between the inner tube 96*a* and main pipe 88) and annular radial walls 97–99. The tubes 96 and walls 97 are welded or otherwise joined together in a fluid tight manner. The inner tubes 96*a*–96*e* have one of their ends spaced from an adjacent wall 97 or 98 to form gaps or slots 101 to permit fluid communication between adjacent acoustic path sections. The side branch acoustic path includes an extension 102 formed by a cylindrical tube or pipe 103 concentric with the main pipe 87. The extended tube 103 communicates with other portions of the acoustic path 92 through a space 104 between the radial walls 88 and 99. An end 106 of the side branch 91 is preferably arranged so that it is coplanar or nearly coplanar with the exhaust end 89 of the main pipe 87. The length of the side branch 91, the sum of the acoustic sections 92*a–f*, 104 and 103 is selected to tune out the loudest frequency or narrow band of frequencies developed by the internal combustion engine as measured in the passenger compartment, cabin of the airplane or on the ground during flyover test. This measurement as in other cases described herein, is taken by operating the engine with a simple straight pipe, i.e. an exhaust pipe without any muffler. The components of the muffler 86 are preferably made of titanium or other high temperature resistant material such as INCONEL X to take advantage of the weight, strength and corrosion resistance of these material.

Figure 7:
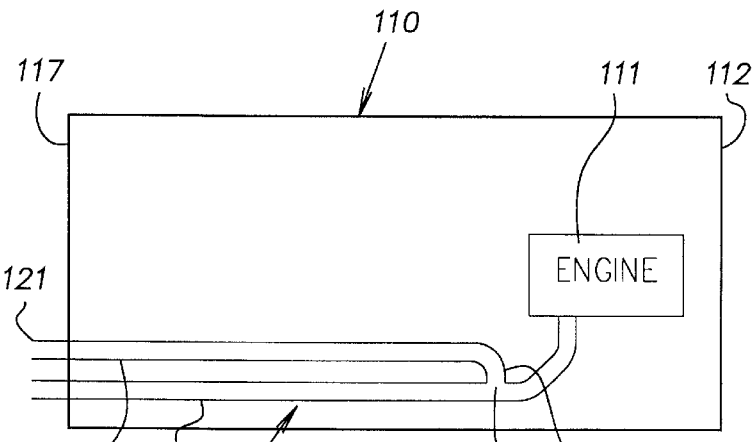
FIG. 7 is a diagrammatic representation of a vehicle with an exhaust system with a simplified side branch muffler of the invention.

Referring now to FIG. 7, there is shown another embodiment of the invention. A motor vehicle diagrammatically indicated at 110 such as a passenger car or truck has an internal combustion engine 111 adjacent its front 112 and an exhaust system 113 coupled to the engine 111. The exhaust system 113 includes a main pipe 114 and a side branch muffler pipe 116. Both the main pipe 114 and side branch muffler pipe 116 terminate adjacent a rear 117 of the vehicle. The side branch pipe is open at an end 118 to the main pipe 114 through a side opening 119 and is open at a rear end 121. The side branch 116 runs closely parallel to the main pipe 114. The length of the side branch 116, as in earlier embodiments, is tuned to reduce the loudest frequency or narrow band of frequencies as measured in the passenger compartment of the vehicle first using a straight pipe without a muffler. The operation of the side branch muffler 116 is essentially the same as that described above in connection with other embodiments of the invention. Wave fronts of sound pressure waves are reflected back from the remote open end 121 to the open end 118 at the main pipe 114 to attenuate successive pressure waves. The side branch 116 has a cross-sectional area preferably the same as or similar, i.e. at least 70%, of the area of the main pipe 114.

Figure 8:
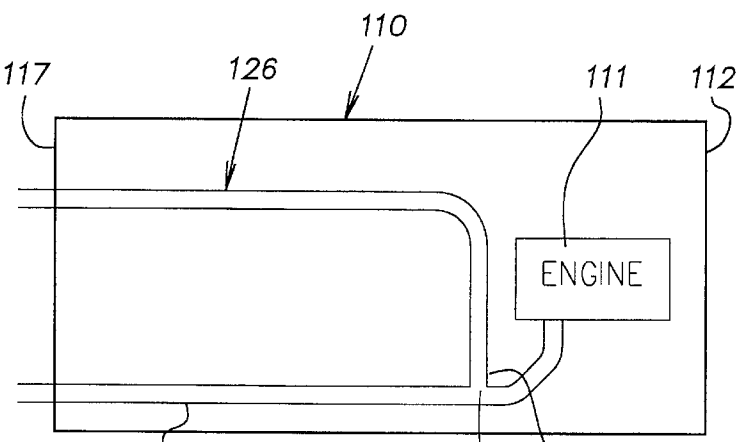
FIG. 8 is another diagrammatic representation of a simplified side branch muffler in an exhaust system of the invention.

FIG. 8 illustrates a further embodiment of the invention similar to that of FIG. 7 and the same reference numerals are used for like parts. In this arrangement, a side branch pipe muffler 126 extends rearwardly along a path adjacent a side of the vehicle opposite the main pipe 114. As before, the length of the side branch 126, open at both ends, is selected to attenuate the frequency or narrow band of frequencies that are loudest in the passenger compartment. The side branch mufflers of FIGS. 7 and 8 have the potential of carrying large portions of the exhaust gas flow from the engine 111 and thereby improve the efficiency of the engine 111 and/or reduce the costs of the exhaust system.

Figure 9:
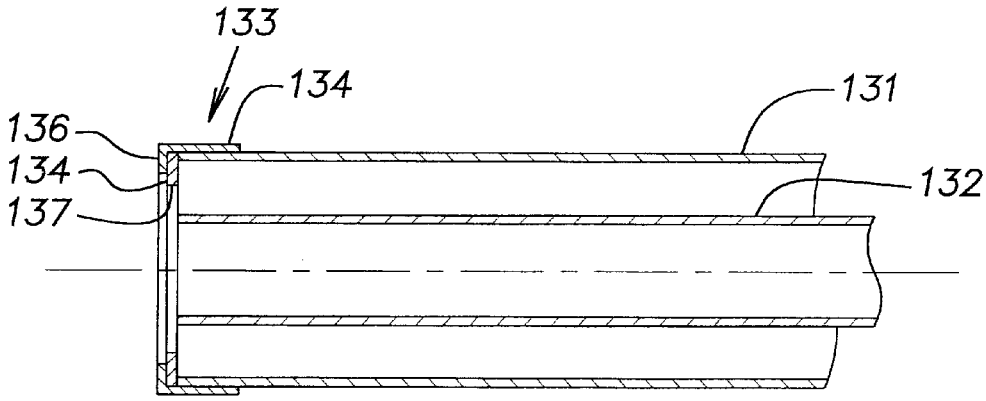
FIG. 9 is a fragmentary view of another modified form of the muffler constructed in accordance with the invention.
Figure 10:
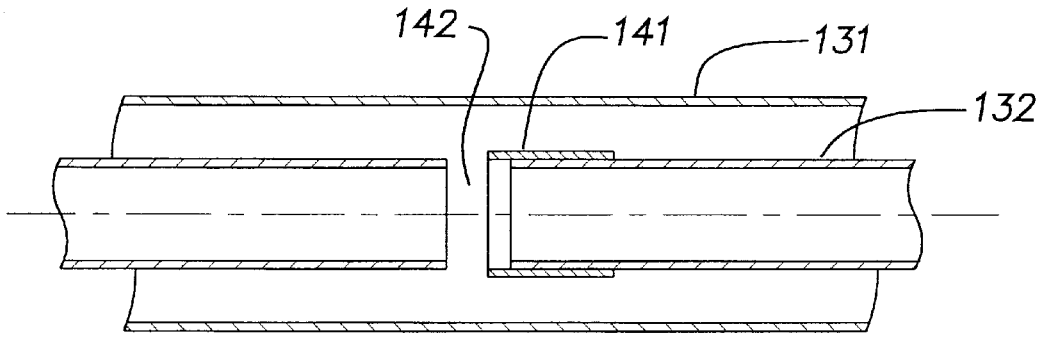
FIG. 10 is a fragmentary view of an additional modification of a muffler constructed in accordance with the invention.

FIGS. 9 and 10 illustrate structures that can be used to fine tune the sound produced by a side branch muffler such as described hereinabove or similar side branch mufflers. In FIGS. 9 and 10, a portion of a side branch muffler 131 is concentrically arranged around a main pipe 132. An adjustable aperture device 133 in FIG. 9 has a cylindrical sleeve 134 telescoped closely over the outside diameter of the side branch 131. The cap 133 has a flange or end wall 136 and a replaceable apertured disc 134 captured within the flange. The size of the aperture, designated 137, is adjustable by selecting a similar disk with a different size aperture. Alternatively, the device can have an iris diaphragm like that in a camera to adjust the size of the aperture 137. The tone of the exhaust from the muffler can be adjusted by selecting the size of the aperture.

In the arrangement of FIG. 10, a sleeve member 141 is telescoped closely over the main pipe 132 and is used to adjust the size of the area of the opening designated 142 to the side branch 131 for purposes of obtaining a desired tone in the side branch muffler.

Referring back to FIG. 5, the technique of fine tuning a side branch muffler, either by a manufacturer of the muffler for the determination of a final production design or by a user of a vehicle employing the muffler, can be applied to open/closed side branch mufflers such as disclosed in my aforementioned U.S. Pat. Nos. 5,952,625 and 6,199,658. This technique is depicted in FIG. 5 where the annular sleeve 86 is fitted with an essentially fluid tight annular end wall 146. As indicated in FIG. 5, the end wall 146 converts the muffler 66 to an open/closed end side branch muffler device. The sleeve 86 and end wall 146 can be moved axially on the main pipe 67 and the tube 68*e* to accomplish this fine tuning.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. For example, the side branch pipe and/or the main pipe can have non-circular cross-sections. The invention has application to highway tractors, motorcycles, and other internal combustion operated equipment. Accordingly, the patent is not to be limited in scope and effect to the specific embodiments herein shown and described nor in any other way that is inconsistent with the extent to which the progress in the art has been advanced by the invention.

What is claimed is:

1. A side branch muffler comprising a main pipe and a side branch pipe, the side branch pipe having a portion surrounding the main pipe, said portion having a plurality of interconnected acoustic paths folded alongside one another, the side branch pipe having one end open to the main pipe and another open end exhausting to the atmosphere separately from gas flow through the main pipe, the side branch communicating with the main pipe through an opening in the wall of the main pipe that has an area that is at least 70% of the average cross-sectional area of the main pipe.

2. A side branch muffler as set forth in claim 1, wherein the side branch pipe has a minimum cross-sectional area that is at least 70% of the average cross-sectional area of the main pipe.

3. A side branch muffler as set forth in claim 1, including an adjustable sleeve at the end of the side branch open to the atmosphere, the sleeve being adapted to change the effective length of the side branch when adjusted to cause the muffler to be tuned to the acoustics of a vehicle on which the muffler is installed.

4. A side branch muffler as set forth in claim 3, wherein the sleeve has an apertured end wall.

5. A side branch muffler as set forth in claim 1, wherein the side branch opening to the atmosphere is fitted with an aperture, the aperture being adjustable in size to adjust the tone of the exhaust.

6. A side branch muffler as set forth in claim 1, including a member for adjusting the size of the opening to the main pipe to adjust the tone of the exhaust.

* * * * *